US010132454B2

(12) United States Patent
Li

(10) Patent No.: US 10,132,454 B2
(45) Date of Patent: Nov. 20, 2018

(54) ELECTRONIC FOUNTAIN CANDLE

(71) Applicant: Xiaofeng Li, Shenzhen (CN)

(72) Inventor: Xiaofeng Li, Shenzhen (CN)

( * ) Notice: Subject to any disclaimer, the term of this patent is extended or adjusted under 35 U.S.C. 154(b) by 42 days.

(21) Appl. No.: 15/322,237

(22) PCT Filed: Nov. 18, 2014

(86) PCT No.: PCT/CN2014/091362
§ 371 (c)(1),
(2) Date: Jul. 20, 2017

(87) PCT Pub. No.: WO2015/196706
PCT Pub. Date: Dec. 30, 2015

(65) Prior Publication Data

US 2017/0363260 A1 Dec. 21, 2017

(30) Foreign Application Priority Data

Jun. 25, 2014 (CN) ..... 2014 1 0291186

(51) Int. Cl.
*F21S 6/00* (2006.01)
*F21S 9/02* (2006.01)
(Continued)

(52) U.S. Cl.
CPC ..... *F21S 6/001* (2013.01); *B05B 17/08* (2013.01); *F21S 9/02* (2013.01); *F21S 10/04* (2013.01);
(Continued)

(58) Field of Classification Search
CPC .. F21S 6/001; F21S 9/02; B05B 17/04; B05B 17/08; F21W 2121/02
See application file for complete search history.

(56) References Cited

U.S. PATENT DOCUMENTS 6,241,362 B1 6/2001 Morrison
9,261,248 B2 * 2/2016 Fournier ..... F21V 33/0056
(Continued)

FOREIGN PATENT DOCUMENTS

CN 2483103 Y 3/2002
CN 104048246 A 9/2014
(Continued)

OTHER PUBLICATIONS

Zhu, Yachen, Authorized Officer, State Intellectual Property Office of the P.R. China, International Search Report, International Application No. PCT/CN2014/091362, dated Apr. 3, 2015, 2 pages.

*Primary Examiner* — Karabi Guharay
(74) *Attorney, Agent, or Firm* — Perkins Coie LLP

(57) ABSTRACT

An electronic fountain candle, comprising a transparent or semitransparent outer cylinder (9), a battery compartment, a flow-guiding cover (10), an LED/water pump assembly (4), and a control board (3). A water storage chamber is located at the interior wall of the outer cylinder (9), above the bottom of the battery compartment. The LED/water pump assembly (4) is mounted inside the water storage chamber, and comprises: an LED-PCB board (42) for an LED, as well as a water pump (43) and a water drainage pipe (41). The LED-PCB board (42) is waterproofed, and the water outlet of the water pump (43) is connected to the water drainage pipe (41). The flow-guiding cover (10) is provided with a flow-guiding hole, and the water drainage pipe (41) is in communication with the flow-guiding hole. The peripheral edge of the flow-guiding cover (10) is lower than the upper end face of the outer cylinder (9), and there is a gap, used for draining water, between the flow-guiding cover (10) and the inner wall of the outer cylinder (9). The control board (3) is mounted inside the battery compartment, and the LED/water
(Continued)

pump assembly (4) is electrically connected to the control board (3).

17 Claims, 5 Drawing Sheets

(51) Int. Cl.

| | |
|---|---|
| ***F21V 31/00*** | (2006.01) |
| ***F21S 10/04*** | (2006.01) |
| ***F21V 19/00*** | (2006.01) |
| ***F21V 23/04*** | (2006.01) |
| ***B05B 17/08*** | (2006.01) |
| *F21Y 115/10* | (2016.01) |
| *F21W 121/02* | (2006.01) |

(52) U.S. Cl.
CPC ..... *F21V 19/003* (2013.01); *F21V 23/04* (2013.01); *F21V 31/005* (2013.01); *F21W 2121/02* (2013.01); *F21Y 2115/10* (2016.08)

(56) References Cited

U.S. PATENT DOCUMENTS

| | | | | |
|---|---|---|---|---|
| 9,636,697 | B1 * | 5/2017 | Jih | B05B 17/08 |
| 2006/0120080 | A1 * | 6/2006 | Sipinski | A01M 1/205 362/253 |
| 2007/0053174 | A1 | 3/2007 | Lin | |
| 2013/0223043 | A1 | 8/2013 | Ray | |

FOREIGN PATENT DOCUMENTS

| | | | |
|---|---|---|---|
| CN | 104089241 | A | 10/2014 |
| CN | 203940346 | U | 11/2014 |

* cited by examiner

ELECTRONIC FOUNTAIN CANDLE

CROSS-REFERENCE TO RELATED APPLICATIONS

This application is a 35 U.S.C. § 371 National Stage application of PCT No. PCT/CN2014/091362, filed on Nov. 18, 2014, which further claims the benefits and priority of prior Chinese Patent Application No. 201410291186.0, filed on Jun. 25, 2014. Each of these disclosures are incorporated by reference herein in their entirety.

TECHNICAL FIELD

The present invention relates to an electronic lighting device, and particularly relates to an electronic candle.

BACKGROUND ART

An electronic candle, as a soft decoration, not only has the practicality and safety as lighting, but also has ornamental value and decorative effect. As result, it has been widely used in hotels, churches and with family and many other different places. For an electronic candle that can simulate a real burning candle, its light emission device can simulate the burning state of a conventional mineral candle, as well as create a quiet and peaceful atmosphere. Accordingly, it can make people relaxed, and thus has become very popular.

SUMMARY OF THE INVENTION

One primary object of the present invention is to provide an electronic device that is able to simulate certain natural environmental features and improve atmosphere.

To this end, the present invention proposes an electronic fountain candle, which comprises a transparent or semi-transparent outer cylinder, a battery compartment, a flow guiding cover, an LED-water pump assembly, and a control panel;

wherein the outer cylinder is a hollow tube body, the battery compartment is an inverted cup-shaped body with the cup opening facing down and the cup bottom facing up and disposed in the foregoing tube body, an inner wall of the outer cylinder is located on the cup bottom of the battery compartment and has a water storage chamber;

the LED-pump assembly is installed within the foregoing water storage chamber and comprises an LED-PCB board, which has been mounted with an LED and received a water-proof treatment, a water pump and a water drainage pipe, wherein the water outlet of the water pump is connected to the water drainage pipe;

the flow guiding cover is provided with a flow guiding hole and the water drainage pipe is in communication with the flow guiding hole;

the peripheral edge of the flow guiding cover is lower than an upper end surface of the outer cylinder, and a gap for water drainage is provided between the flow guiding cover and the inner wall of the outer cylinder;

the control panel is disposed within the battery compartment, and the LED-water pump assembly is electrically connected to the control panel.

The electronic fountain candle according to the present invention employs an LED to mimic the real light of a traditional lighting device; and at the same time, its water pump drives a water circulation that can simulate the sound of water flow in a natural environment. In this way, the electronic fountain candle according to the present invention is able to create a natural and tranquil atmosphere. This kind of atmosphere, for many people, can help them to be relaxed, help them to sleep and improve their sleeping quality as well.

DESCRIPTION OF THE EMBODIMENTS

The present invention will be further described in detail with certain exemplary embodiments of the present invention and in reference to the accompanying drawings.

Figure 1:
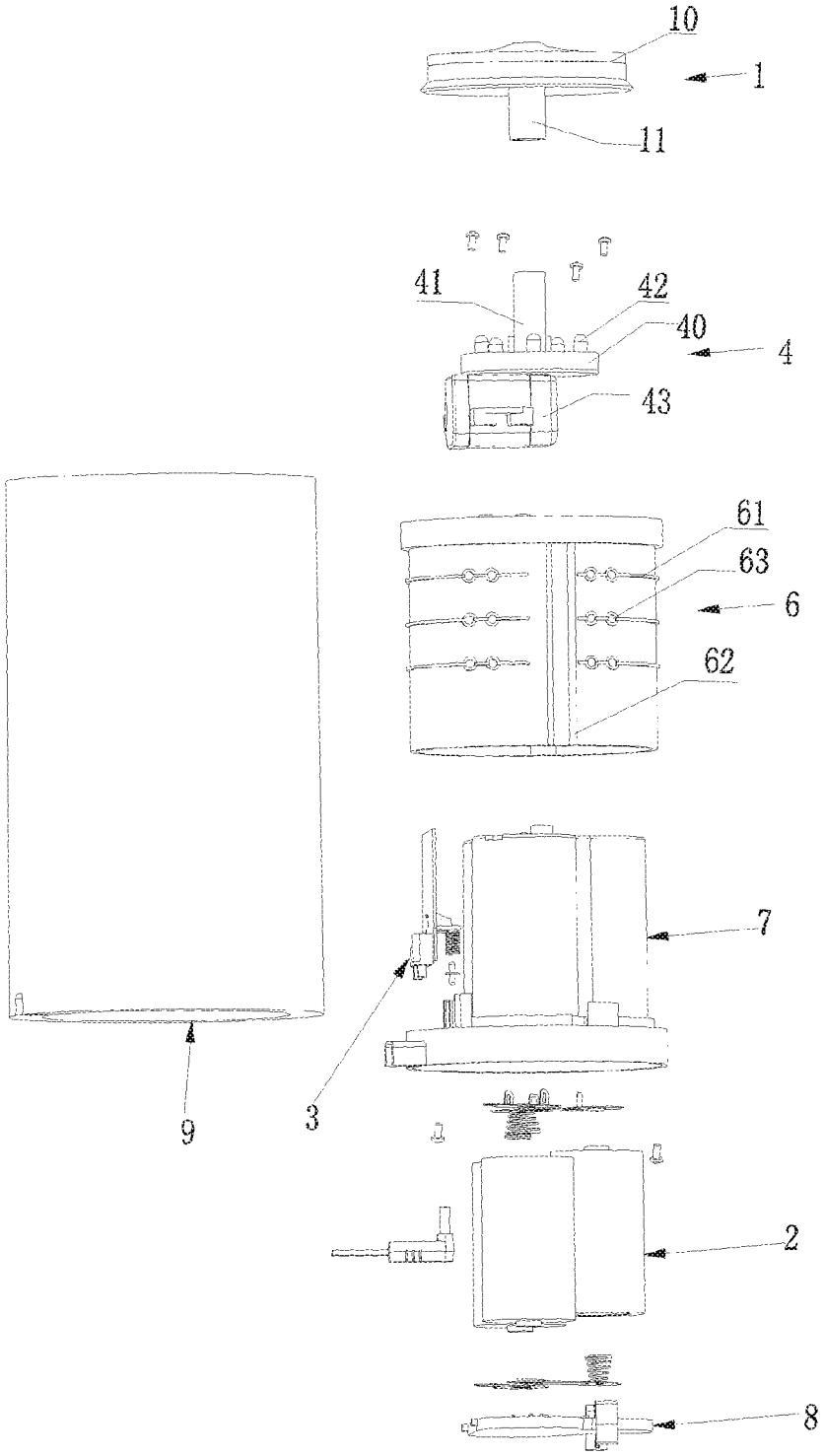
FIG. 1 is an exploded view of the structure of the electronic fountain candle according to the first embodiment of the present invention.
Figure 2:
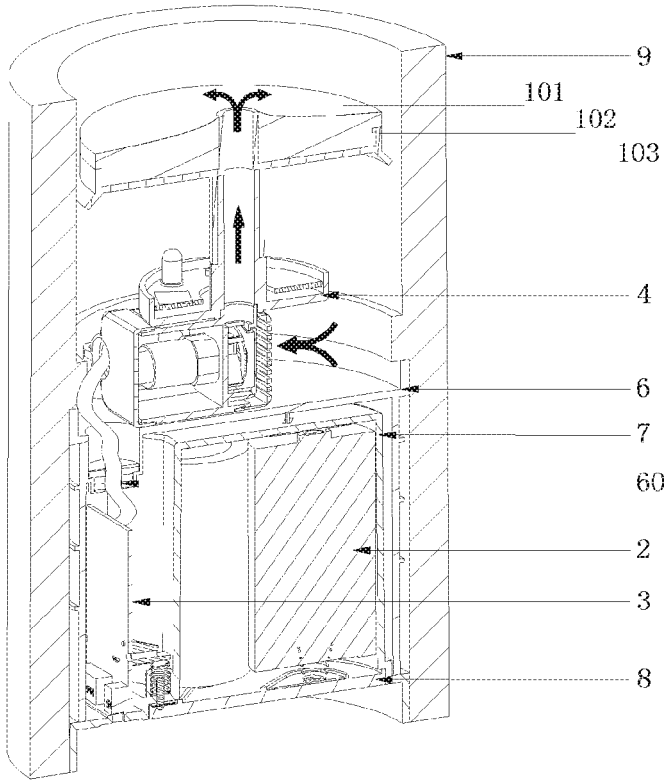
FIG. 2 is a cross sectional view of the electronic fountain candle according to the first embodiment of the present invention.

Exemplary Embodiment 1:

With reference to FIGS. 1 and 2, in this exemplary embodiment of the present invention, the electronic fountain candle comprises an outer cylinder 9, which is in a hollow cylindrical shape. The outer cylinder is either made of paraffin wax or its outer surface is covered by paraffin wax, which helps to mimic the texture and perception of a traditional candle; a base 6 has a cross section in a substantially H shape, which is accommodated within the cavity of the outer cylinder 9; the base is a cup-shaped body that is divided into two parts by a horizontal divider (bottom of the cup) with two opposing openings, wherein in the upper part there is a water storage chamber, which is transparent or semi-transparent, with the opening facing up. The upper part is used for receiving the LED, the water pump and an atomization chip; in addition, the upper part also forms a water storage chamber for receiving flowing water, so as to form a water circulation passage. The lower part is a battery compartment, with its opening facing down; the lower part is used for receiving a battery base 7 and a control panel 3; that is to say, in this exemplary embodiment, the water storage chamber and the battery compartment are integrated together into one unit, the base 6. The battery base 7 is provided in the battery compartment of the base, the opening of the battery compartment is accessible from the exterior via the bottom opening of the outer cylinder 9. The battery compartment cover is removably disposed on the opening of the battery base 7, and battery 2 is placed within the battery base 7. An LED-water pump assembly 4 is disposed within the water storage chamber of the base 6, wherein the LED-water pump assembly 4 comprises a disk shaped tray 40. The water pump 43 is located below the tray; a water drainage pipe 41 connected to the water outlet of the water pump passes through the center of the tray and then extends upwards. An LED light emitting member is installed on an annular LED-PCB board 42, wherein the entire LED-PCB board 42 is disposed in the tray 40. The water drainage pipe 41 of the LED-water pump assembly 4 passes through the center of the LED-PCB board 42, and the LED-PCB board 42 and LED are sealed so as to gain a water-proofing effect by an epoxy resin. A water inlet of the water pump is in communication with the water storage chamber; the atomization chip (not shown in the drawings) is disposed on the tray and connected to either the LED-water pump assembly 4 or the control panel 3. A flow guiding frame 1, which is in a shape of umbrella, comprises a flow guiding column 11 (umbrella shaft) and a flow guiding cover 10 (umbrella panel), wherein the flow guiding column 11 is a hollow cylindrical tube with its lower tube opening connected to the upper tube opening of the water drainage pipe 41 of the LED-water pump assembly 4. A flow guiding hole with one end opening thereof is connected to the center of the flow guiding cover 10 (umbrella panel) forming an opening for the fountain; the flow guiding hole is located in the center of the flow guiding cover 10 (umbrella panel); with the flow guiding hole as the center, the flow guiding cover 10 extends radially and tilts extends downwards in extension. The surface of the flow guiding cover 10 is coated by paraffin wax, which helps to improve the texture of the candle. The outer diameter of an orthographic projection of the flow guiding cover is slightly smaller than the inner diameter of the water storage chamber and the inner diameter of the outer cylinder 9. The water flow exiting the flow guiding column 11 located in the center of the flow guiding cover 10 flows towards the periphery and then falls into the water storage chamber. By way of the controlling the operating state of the water pump by the control panel 3, the electronic fountain candle in this exemplary embodiment is able to create a regular or irregular sound of water flowing and/or water dripping that mimics the water flowing and/or water dripping sound in the natural environment.

More specifically, the flow guiding cover 10 comprises the flow guiding frame and a paraffin wax coating layer 101, wherein the flow guiding frame comprises an upper peripheral edge 102 protruding upwards. The paraffin wax coating layer 101 covers the upper face of the flow guiding frame and is limited by the upper peripheral edge 102 that protrudes upwards. The flow guiding frame also comprises a lower peripheral edge 103 protruding downwards and also towards the surrounding periphery. The lower peripheral edge 103 is able to prevent the splashes generated when water is falling into the water storage chamber from splashing out via the gap between the flow guiding cover and the outer cylinder.

In the foregoing exemplary embodiment, the height of the cup body of the water storage chamber is relatively low, which is connected to the inner wall of the outer cylinder through sealing to form a chamber for water storage. In this way, the specific height of the cup body of the water storage chamber will not affect its water storage function.

On the LED-water pump assembly, one positive electrode and one negative electrode (not shown in the drawings) are provided at different heights. Only when the water in the water storage chamber is high enough to submerge both the positive electrode and the negative electrode, the two electrodes will be electrically connected, and accordingly the pump will be started. On the other hand, when the water storage chamber does not have enough water, when the water level is below the higher electrode, the electrical connected between the two electrodes will be disconnected, and accordingly, the power supply to the water pump will be terminated. As a result, the water pump will stop running. In this way, the water pump is prevented from idling, which helps to protect the motor of the water pump and prolong the service life of the water pump.

Figure 3:
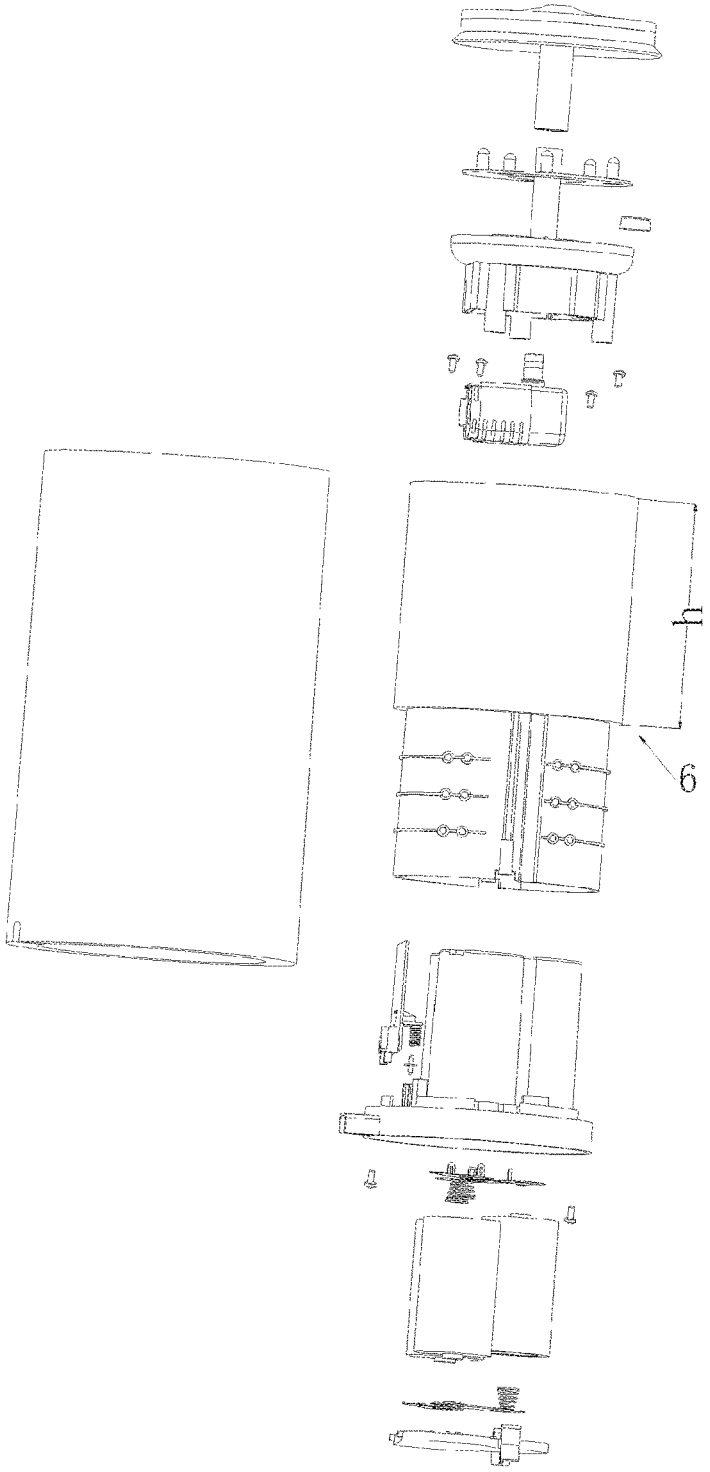
FIG. 3 is an exploded view of the structure of the electronic fountain candle according to the second embodiment of the present invention.
Figure 5:
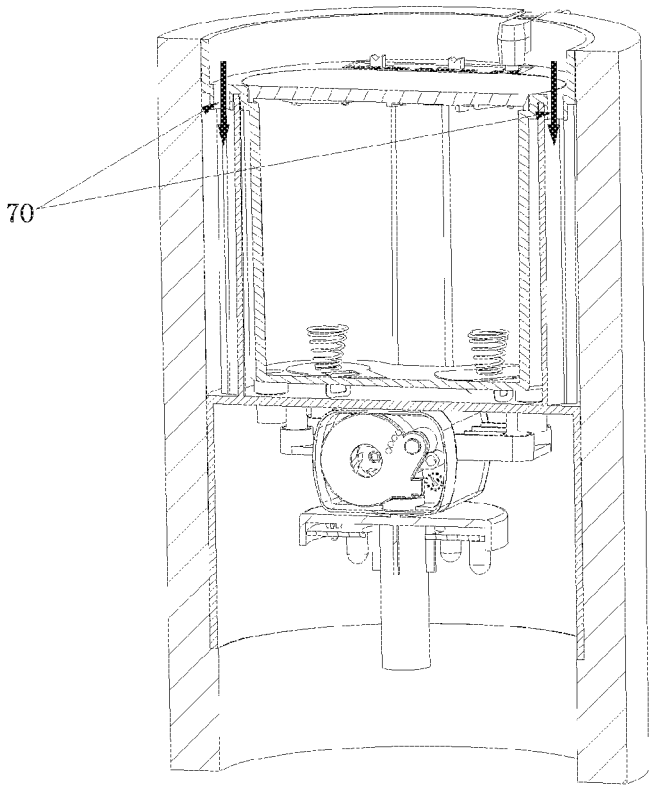
FIG. 5 is a cross sectional view of the inverted electronic fountain candle according to the second embodiment of the present invention.

Exemplary Embodiment 2:

In reference to FIGS. 3 and 5, this exemplary embodiment of the present invention is different from the previous exemplary embodiment in that in this exemplary embodiment, the height h of the water storage chamber in the base 6 is relatively high. Accordingly, the LED-water pump assembly can be accommodated within the cup body thereof. In addition, the flow guiding cover is disposed at the location of cup opening. As a result, the water storage chamber is able to independently operate the water circulation.

Exemplary Embodiment 3:

Based on the technical solutions of the Exemplary embodiment 1 and Exemplary embodiment 2 provided above, a person of ordinary skill in the art is able to understand that the structure of the water storage chamber can be completely omitted. Accordingly, the top wall of the battery compartment (cup bottom) will be connected to the inner wall of the outer cylinder through sealing, which allows a water storage chamber body to be formed on top of the battery compartment, and the LED-water pump assembly 4 can be accommodated within the water storage chamber body and electrically connected to the control panel within the battery compartment in a waterproofing manner.

In the foregoing exemplary embodiment, for the base 6, in particular its battery compartment part, protruding horizontal ribs 61 have been provided on the surface of the outer wall thereof, which are distributed around the circumference thereof; In addition, vertical grooves 62 may also be provided thereon, which are distributed vertically. With reference to FIG. 5, it can be seen that in the connection between the battery base 7 and the battery compartment of the base 6, the battery base 7 extends outwards to form a platform at the opening of the battery base 7. The outer diameter of the platform is greater than the outer diameter of the battery compartment. Moreover, the platform is tightly connected to the inner wall of the outer cylinder. On the surface of the platform between the outer diameter of the battery compartment and the inner diameter of the outer cylinder, at least one wax loading hole 70 is provided thereon. Through the foregoing wax loading hole 70, wax can be loaded into the space between the outer wall of the base 6 and the inner wall of the outer cylinder 9, which allows the base 6 to be tightly bonded to the outer cylinder 9. At the same time, due to the existence of the horizontal ribs and the vertical grooves provided on the outer wall of the base 6, the wax will be loaded into the vertical grooves, which further helps to enhance the bond between the base 6 and the outer cylinder 9. Furthermore, a plurality of through holes 63 may be provided on the side wall of the base 6. As a result, the wax can also be loaded into the plurality of through holes 63, which even further enhances the bond between the base 6 and the outer cylinder 9.

The control panel 3 is arranged on the battery base 7; the control panel 3 is also electrically connected to the battery base 7. A through hole 60 is provided on the horizontal divider of the base 6. Through the through hole 60, the connecting wires of the LED-water pump assembly 4 and the atomization chip are connected to the control panel arranged within the battery compartment. In addition, the foregoing through hole has also received a waterproof treatment, which helps to prevent the water in the water storage chamber from leaking into the battery compartment.

Figure 4:
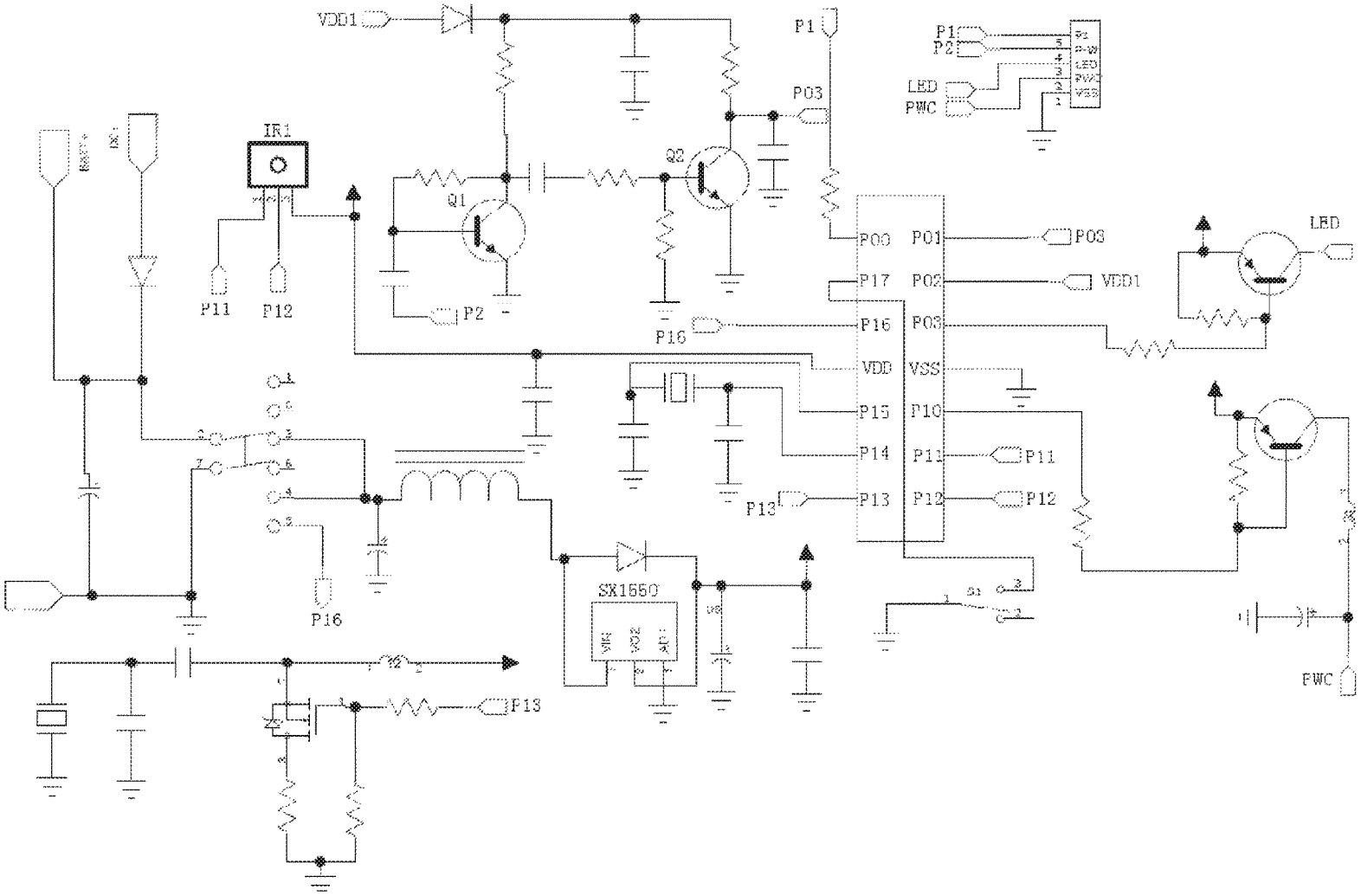
FIG. 4 is a schematic circuit diagram of the first and second embodiments of the present invention.

The circuits of the control panel will be further described as follows, please refer to FIG. 4.

1. Power supply module: the input power supply is 5V or 4.5V by 3 batteries, which is controlled by the switch 1; when the switch 1 is in the ON state (the switch contact 3 and contact 6 are connected), the inputted power is first increased to 5V by SX1550, and then supplied to MCU, water pump, LED, atomization chip, and an end for infrared remote control for supplying electric power respectively. The power supply module may also be a rechargeable power supply module, which comprises a rechargeable battery and a battery recharging managing sub-module.

2. Water detection module: as shown in the circuit diagram, the first contact P1 and the second contact P2 are disposed in water; MCU opens the P02 (VDD1) contact to supply power for the water detection module, and at the same time, the first contact P1 outputs a square wave of 160 Hz; in the case when there is water, the square wave outputted from the contact P1 will be transmitted to the contact P2 via the medium water, and then enters the transistor Q1 for further signal amplification. Next the amplified signal is sorted by the transistor Q2, and then transmitted to the P01 (P03) contact of MCU; in such a case, if the P01 (P03) contact can detect a waveform, it will be determined that there is water; if no waveform can be detected, it will be determined that there is no water. If the switch of the water pump or the switch of the atomization device is in an open state and it is determined that there is water, the water pump or the atomization device will start; but if there is no water, the water pump and the atomization device will not start.

3. Remote receiving module: the contact P12 and contact P11 of MCU are connected to the infrared receiving end; P11 is the contact for receiving signal, and P12 controls the receiving end; they can save power according to certain specific needs, more specifically; when the P12 is at a high level, it will close the receiving end, while when the P12 is at a low level, it will open the receiving end. According to the received signal, MCU respectively controls the ON and OFF states of the output contact P03 (LED), P10 (water pump) and P13 (atomization chip). When the output contact P03 (LED) is at a low level, the LED will be turned on, while when it is at a high level, the LED will be turned off; when the output contact P10 (water pump) is at a low level, the water pump will be started; when the output contact P13 (atomization chip) outputs a square wave form of 100 KHz, the atomization chip will be in an ON state, while when the output contact P13 is at a low level, the atomization chip will be in an OFF state.

4. Switch module: the contact 17 of MCU is a switch for TIMER, and the contact 16 of MCU is a switch for water pump; if the respective contact is connected to the ground, the TIMER or the water pump will be started; MCU also controls the ON/OFF states of P03 (LED) and P10 (water pump).

5. Atomization module: the contact 13 of MCU outputs a square waveform of 100 KHZ to control the ON/OFF state of MOS; the atomization chip can vibrate by adjusting capacitance; water is used as a medium, and an ultrasound directed pressure is applied to the water to disperse the liquid water molecules to form a natural flowing mist.

The content provided above is the further description for some preferred embodiments of the present invention, which should not be considered as limiting the embodiments of the present invention. For a person of ordinary skill in the art, without departing from the inventive concept of the present invention, a number of simple modifications and substitutions can be made to the present invention, which shall be considered as within the scope of the present invention. For example, in the first exemplary embodiment, for the specific way in which the water storage chamber and the battery compartment are provided, the two components may be provided separately, which may need further waterproofing treatment for the electrical connections to ensure that the electronic control part is not affected by the water, and that the respective structural parts can ensure water circulation.

The invention claimed is:

1. An electronic fountain candle, comprising:
an outer cylinder resembling a candle body;
a battery compartment;
a flow guiding frame;
an LED-pump assembly; and
a control panel, wherein:
the outer cylinder includes a hollow interior,
the battery compartment has an inverted cup-shaped body with an opening that faces downward and a cup bottom that faces upward, the battery compartment disposed within the hollow interior of the outer cylinder,
the LED-pump assembly is positioned within a water storage chamber and comprising a circuit board and an LED, the LED-pump assembly further coupled to a water pump and a water drainage pipe, wherein an outlet of the water pump is coupled to the water drainage pipe,
the flow guiding frame comprises a flow guiding hole and a flow guiding cover, wherein the flowing guiding hole is in communication with the water drainage pipe, and wherein
a first gap for water drainage is provided between the flow guiding cover and the inner wall of the outer cylinder, the flow guiding cover including a sloped surface that tilts downwards as the surface extends from a center of the flow guiding cover toward the inner wall of the outer cylinder to allow water to flow from the flow guiding hole to the water storage chamber via the first gap,
the flow guiding frame further comprising an upper peripheral edge protruding upwards to secure the flow guiding cover and a lower peripheral edge protruding downwards toward the inner wall of the outer cylinder, both the upper peripheral edge and the lower peripheral edge being lower than an upper end surface of the outer cylinder, wherein a second, smaller gap for water drainage is provided between the lower peripheral edge and the inner wall of the outer cylinder such that the lower peripheral edge is configured to prevent water from splashing through the first gap, and
the control panel is electrically connected to the LED-pump assembly.

2. The electronic fountain candle of claim 1, further comprising a hollow flow guiding column for water drainage, wherein one end of the flow guiding column is in communication with the water drainage pipe and the other end of the flow guiding column is connected to the flow guiding cover and is in communication with the flow guiding hole.

3. The electronic fountain candle of claim 2, wherein the water storage chamber is disposed within the hollow interior of the outer cylinder and accommodates that the LED-water pump assembly within the water storage chamber.

4. The electronic fountain candle of claim 3, further comprising a battery base, wherein the control panel is electrically connected to the battery base.

5. The electronic fountain candle of claim 4, wherein:
the battery compartment comprises a battery base that extends outwards to form a platform surrounding the opening of the battery compartment, an outer diameter of the platform is greater than the outer diameter of the battery compartment, and the platform is tightly coupled to the outer cylinder.

6. The electronic fountain candle of claim 3, wherein the water storage chamber and the battery compartment are integrated to form one unit.

7. The electronic fountain candle of claim 1, wherein the flow guiding cover is circular in shape, and the flow guiding hole is located in the center of the flow guiding cover.

8. The electronic fountain candle of claim 7, wherein a top point of the upper surface of the flow guiding cover is vertically lower than the upper end of the outer cylinder.

9. The electronic fountain candle of claim 1, further comprising an atomization circuitry disposed within the water storage chamber and electrically connected to either the circuit board of the LED-pump assembly or to the control panel.

10. The electronic fountain candle of claim 1, wherein the LED-pump assembly further comprises a tray, wherein the circuit board of the LED-pump assembly is mounted on the tray, and the water drainage pipe passes through a section of the tray.

11. The electronic fountain candle of claim 1, wherein:

the flow guiding cover comprises a paraffin wax coating layer, wherein the paraffin wax coating layer covers an upper face of the flow guiding frame and extends to the upper peripheral edge.

12. The electronic fountain candle of claim 1, wherein the water storage chamber is disposed over the battery compartment.

13. The electronic fountain candle of claim 1, wherein an inner wall of the outer cylinder is positioned on the bottom of the battery compartment and includes a water storage chamber body.

14. The electronic fountain candle of claim 1, wherein the LED-pump assembly is water-proof.

15. The electronic fountain candle of claim 1, further comprising at least one wax loading hole, through which wax can be loaded into at least part of the hollow interior of the outer cylinder in vicinity of an inner wall of the outer cylinder.

16. The electronic fountain candle of claim 1, further comprising at least one groove to accommodate wax that is poured into at least part of the hollow interior of the outer cylinder.

17. The electronic fountain candle of claim 1, wherein the LED-pump assembly includes a first electrode and a second electrode positioned at different heights such that the LED-pump assembly only operates when water in the water storage chamber submerges both the first electrode and the second electrode.

* * * * *